US007581601B2

(12) United States Patent
Laureano et al.

(10) Patent No.: US 7,581,601 B2
(45) Date of Patent: Sep. 1, 2009

(54) DRILL CUTTINGS RE-INJECTION SYSTEM

(75) Inventors: Marcio Laureano, Katy, TX (US); Thomas William Robertson, Aberdeen (GB)

(73) Assignee: Aker Kvaerner Subsea, Inc., Houston, TX (US)

( * ) Notice: Subject to any disclaimer, the term of this patent is extended or adjusted under 35 U.S.C. 154(b) by 234 days.

(21) Appl. No.: 11/439,608

(22) Filed: May 24, 2006

(65) Prior Publication Data

US 2006/0278438 A1 Dec. 14, 2006

Related U.S. Application Data

(60) Provisional application No. 60/684,099, filed on May 24, 2005.

(51) Int. Cl.
*E21B 21/01* (2006.01)
*E21B 17/18* (2006.01)

(52) U.S. Cl. ..... 175/209; 175/66; 175/207; 175/215

(58) Field of Classification Search ..... 175/207, 175/215, 209, 66
See application file for complete search history.

(56) References Cited

U.S. PATENT DOCUMENTS 4,903,774 A 2/1990 Dykes et al. ..... 166/363
5,085,277 A 2/1992 Hopper ..... 166/341

OTHER PUBLICATIONS

PCT International Search Report and Written Opinion for PCT/US2006/020141, dated Oct. 4, 2007.

*Primary Examiner*—Jennifer H Gay
*Assistant Examiner*—Brad Harcourt
(74) *Attorney, Agent, or Firm*—Howrey LLP

(57) ABSTRACT

A system to re-inject drill cuttings slurry into a well formation for the storage of the cuttings. The system may include a pressure containing conduit that creates a flow path to an annulus within the well formation. The system may include an injection inlet, a drilling guide base, an injection adapter having a circular gallery, an injection mandrel having at least one injection port, and an annulus created between the injection mandrel and an inner casing. The slurry may be injected into the annulus while still drilling the wellbore. The location of the injection inlet may be positioned relative to the circular gallery of the injection adapter such that a cyclone effect is created within gallery minimizing erosion due to the flow of the slurry. The injection mandrel may be adapted to allow the passage of drilling mud to a downhole drilling location while injecting slurry into the casing annulus.

30 Claims, 8 Drawing Sheets

DRILL CUTTINGS RE-INJECTION SYSTEM

CROSS REFERENCE TO RELATED APPLICATION

This application is a non-provisional utility application claiming priority to U.S. Provisional patent application No. 60/684,099, entitled, "Drill Cuttings Re-injection Systems," by Andy Dyson, Tom Robertson, and Marcio Laureano, filed May 24, 2005, incorporated by reference herein in its entirety.

BACKGROUND OF THE INVENTION

1. Field of the Invention

The present invention relates generally to a system used to re-inject drilling cuttings or drilling slurry into an annulus in a subsea well. The present invention provides a system for a providing an increased re-injection rate into a pressure containing conduit while minimizing erosion caused by the flow of the re-injected drill cuttings. The present invention discloses configuring the re-injection inlet into a pressure containing conduit such that a cyclone effect is produced in the flow path of the drill cuttings, which minimizes erosion and may eliminate the need to hard face components of the system.

2. Description of the Related Art

Environmental concerns can be an important issue in the drilling of subsea wells in different regions of the world. In particular, one environmental concern is the storage and safe disposal of cuttings produced during the drilling of subsea wells. Some regions with high particularly high environmental standards are the artic sector and the Norwegian sector of the North Sea. Regulatory requirements have been introduced in the Norwegian sector that would allow for the re-injection of drilling cuttings into the formation while the well is still being drilled.

When drilling a subsea well, drilling mud is used to bring the drill cuttings to the surface where the mixture of drilling mud and cuttings, or slurry, may be filtered and stored. After being filtered, the slurry must be stored or disposed in accordance with environmental regulations of the region. As discussed above, one acceptable form of storage is the re-injection of the slurry into the well formation. The re-injection of slurry can be a complex process and can greatly increase the drilling time, and thus increase the cost spent on drilling a well.

When re-injecting slurry into the well formation for storage the re-injection flow rate may be increased in an attempt to reduce the time that a drilling vessel needs to remain at a well. On disadvantage to increasing the re-injection flow rate is the increase in erosion of components used in the re-injection system. Slurry is a rather abrasive mixture as it contains drillings as well as potentially containing pieces broken off the drilling bit. Increased erosion decreases the useable life of a re-injection system and potentially could lead to failure during use. Although it is desirable to increase the re-injection flow rate, it must be balanced with the erosion caused by the re-injected slurry.

The re-injection of slurry into a well formation may also lengthen the overall drilling time if the well cannot be drilled simultaneous to the re-injection of the slurry. In this instance the re-injection of slurry may be too costly to the overall drilling of a well. The modification of an existing wellhead to enable the use of a re-injection system may also increase the drilling costs per well. The re-injection system may also require a special running tool to install the system onto a subsea wellhead. The special running tool would also be an additional cost to a drilling company as well as the additional time and cost to train personal to use the special running tool. For these reasons, drilling companies may not be interested in using a re-injection system.

The re-injection of slurry into an annulus of the well formation may cause undue wear on well components. For example, the slurry may be injected in an annulus that is between an inner casing and injection mandrel with the slurry being injected from the mandrel side towards the casing. The opening in the injection mandrel may cause the slurry to flow directly at the inner casing potentially causing erosion the inner casing. This possibility of erosion requires hard facing of the inner casing in an attempt to prevent undesirable erosion and possibly failure caused by the flow of the slurry. Hard facing of the casing is expensive and adds to the overall drilling costs associated with the well.

During the drilling stage, the primary function of the well formation is to allow the drilling of the well to begin the production of hydrocarbons. A re-injection system that also utilizes the well formation to store drill cuttings may interfere with the drilling process causing the operators to switch between the two functions. Doing so would lengthen the time required to drill the well, thus increasing the overall drilling costs. To minimize costs, it would be beneficial if the re-injection system allowed for the injection of cuttings for storage while the well was being drilled. One possible problem is the transfer of drilling mud to the drilling site. The mud may have to travel through the re-injection system. It would be beneficial if a re-injection system allowed for the re-injection of slurry into the well while allowing for the passage of drilling mud downhole.

In light of the foregoing, it would be desirable to provide a re-injection system that is adapted to store drill cuttings and/or slurry in an annulus of the well formation. It would further be desirable that the re-injection system may be connected to existing well head designs. It would also be desirable to provide a re-injection apparatus that provides for an increased diameter flow path thus allowing an increased flow of slurry, but also an apparatus that is configured such that the flow of slurry causes minimal erosion to the components of the apparatus. Additionally, it would be desirable to provide an injection system that has balanced injection ports that minimize the erosion on the boundary elements of the storage annulus. It would also be desirable to provide a re-injection system that may allow the drilling of the well concurrent to the injection of slurry within the well formation. Further, it would be desirable for the system to allow for the flow of material, such as drilling mud or cement, through the injection system to downhole locations without interrupting the re-injection of the slurry.

The present invention is directed to overcoming, or at least reducing the effects of, one or more of the issues set forth above.

SUMMARY OF THE INVENTION

The present application discloses a system or apparatus to re-inject drill cuttings into a well formation for storage. In particular, a pressure containing conduit is disclosed with the provision for a remotely operated subsea connection for the re-injection of drill cuttings.

In one embodiment, the system to re-inject cuttings comprises at least one injection inlet, a drilling guide base, an injection adapter ring within the drilling guide base, an injection mandrel within the injection adapter ring, and an inner casing. The at least one injection inlet is in fluid communication with at least one flow path of the drilling guide base, which in turn is in fluid communication with a circular gallery of the injection adapter ring. The injection mandrel includes at least one injection port that is in communication with the circular gallery. The inner casing of the system creates an annulus between the inner casing and the injection mandrel, wherein cuttings may be injected into the annulus through the at least one injection port. The injection inlet may be positioned relative to the circular gallery such that a cyclone effect is created within the gallery. The drilling guide base may be adapted to connect to a conventional subsea wellhead. This system may also be used to inject other materials or media for the storage and disposal as would be appreciated by one of ordinary skill in the art having the benefit of this disclosure.

The at least one injection port of the injection mandrel may be adapted to reduce erosion of the injection mandrel due to the flow of the drill cuttings. For example, the injection port may be angled to align with the flow of the drill cuttings. Additionally, the entrance into the injection port may include rounded corners. The injection mandrel may include at least one flow-by-port to allow the passage of material through the injection mandrel. The at least one flow-by port may allow the passage of cement and/or drilling mud through the injection mandrel without interfering with the re-injection of drill cuttings.

In one embodiment, the system includes multiple injection inlets and the injection mandrel includes multiple injection ports. The multiple injection inlets and multiple injection ports may be balanced to within the system to reduce erosion on the inner casing due to the re-injection of drill cutting and/or slurry.

The re-injection system may include an isolation sleeve that is positioned between the drilling guide base and the injection adapter ring. The isolation sleeve may be adapted to move from a first position to a second position, such that when in the second position the isolation sleeve blocks the fluid flow path between the drilling guide base and the circular gallery of the injection adapter ring. The sleeve may be used to block the fluid flow path into the injection adapter ring when the drilling of the well has been completed. Shear pins may be used to secure the isolation sleeve in both its first position and a detent ring may hold the isolation sleeve in its second position.

The injection system may include a second inner casing within the first inner casing that allows for the drilling to be performed simultaneous to the re-injection of drill cuttings in the annulus between the first inner casing and the injection mandrel. In one embodiment, the first inner casing may be a 13⅜" casing and the second inner casing may be 10¾" casing. The injection inlet may have at least a 4" inner diameter. The injection mandrel may be an 18¾" mandrel. The actual dimensions components of the re-injection system, such as the inner casings, injection inlet, and injection, could be varied depending on application and necessary flow rate as would be appreciated by one of ordinary skill in the art having the benefit of this disclosure.

In one embodiment, an apparatus is provided for the re-injection of drill cuttings into a well formation comprising a pressure containing conduit, means for injecting drill cuttings into a flow path of the pressure containing conduit, means for creating a cyclone effect within the flow path of the pressure containing conduit, a first annulus, a second annulus, and means for directing the flow of drill cutting into the first annulus. The means for injecting drill cuttings into a flow path of the pressure containing conduit may include a single injection inlet or multiple injection inlets. The injection inlets may be positioned at opposite sides of the pressure containing conduit. The means for injection drill cuttings includes injection inlets may be configured to have a large flow path such as having a four inch inner diameter. The large flow path of the apparatus may allow the apparatus to inject various materials or media into the well formation for storage and disposal. The pressure containing conduit may include a circular flow path around the conduit. The means for creating a cyclone effect may include the positioning of the means for injecting drill cuttings relative to the circular flow path such that a cyclone effect is created within the conduit. The second annulus of the pressure containing conduit is located within the first annulus of the pressure containing conduit. The means for directing the flow of drill cutting into the first annulus may include an injection mandrel contained within the pressure containing conduit. The injection mandrel may include at least one injection port, wherein the at least one injection port is in communication with the first annulus and the at least one injection port is configured to direct the flow of the drill cuttings into the first annulus.

The apparatus may further include means for the passage of material through the apparatus to a downhole location. The means may include by-pass ports located within the injection mandrel that allow for the passage of material through the injection mandrel without interrupting the injection of drill cuttings through the injection ports into the first annulus. The apparatus may further include means for preventing the injection of drill cuttings into the flow path of the pressure containing conduit. The means may include a sleeve that is positioned on the outside of the pressure containing conduit. The sleeve may be movable between a first position and a second position, wherein in the second position the sleeve blocks a flow inlet into the pressure containing conduit.

In another embodiment, a method is disclose to inject a slurry into a wellbore annulus comprising the steps of filtering the slurry of drilling mud and drill cuttings and pumping the filtered slurry through at least one injection inlet into a pressure containing conduit, the at least one inject inlet being in fluid communication with a flow path within a drilling guide base. The method further includes the steps of pumping the filtered slurry through the flow path of the drilling guide base to a circular gallery of an injection adapter ring and circulating the filtered slurry around the circular gallery, which is in fluid communication with at least one injection port of an injection mandrel. The method also includes the step of directing the filtered slurry through the at least one injection port to an annulus formed between the injection mandrel and an inner casing within the pressure containing conduit.

The method may further include the step of moving an isolation sleeve to block the fluid communication between the drilling guide base and the injection adapter ring. The method may include an injection inlet that is positioned relative to the circular gallery of the injector adapter ring such that a cyclone effect is created within the fluid flow path. The method may further include the step of drilling the wellbore while filtered slurry is re-injected into the annulus formed between the injection mandrel and an inner casing. The at least one injection port of the injection mandrel may be adapted to minimize erosion to the injection mandrel. The injection mandrel may include at least one bypass port and the method may further include the step of pumping material through the at least one bypass port.

Another embodiment disclosed is directed to a system for storing the drilling slurry from multiple subsea wells of a template or system. One well of the template or system may be adapted to store drilling slurry comprising at least one injection inlet, a template receptacle, a sliding sleeve bore protector, an injection adapter ring, an injection mandrel, and an inner casing that forms an annulus with the injection mandrel. Drilling slurry may enter the well through the at least one injection inlet. The template receptacle may include at least one flow path in communication with the at least one injection inlet and the injection adapter ring may include a circular gallery that is in fluid communication with the at least one flow path of the template receptacle, such that drilling slurry may flow from the at least one injection inlet to the circular gallery. The injection mandrel has at least one injection port that may be in fluid communication with the circular gallery and allows the injection of drilling slurry to be injected into the annulus between the inner casing and the injection mandrel. The sliding sleeve bore protector may be adapted to block fluid communication between the circular gallery of the injection adapter ring and the at least one flow path of the template receptacle.

The system may include at least a second well adjacent to the well adapted to store drilling slurry, wherein drilling slurry from the second well may be brought to the surface to be filtered. The system also includes a first fluid conduit for the transportation of the filtered drilling slurry to the at least one injection inlet of the well adapted to store the drilling slurry. The system may further comprise a second fluid conduit for the transportation of filtered drilling slurry from a third well to the at least one injection inlet for the re-injection of the filtered slurry.

Another embodiment of the present disclosure is a method of installing a re-injection system on a subsea wellhead. The method comprising connecting a sliding sleeve to an interior surface of an injection adapter ring, wherein the adapter ring has an interior bore and the sliding sleeve is movable from a first closed position to a second open position. The slidable sleeve protects the sealing surface on the interior bore of the injection adapter ring. The method may also include installing the injection adapter ring onto a template receptacle that includes an injection flow loop and a sliding sleeve, wherein the adapter ring moves the sliding sleeve to the open position. The method may also include using the slidable sleeve in the first position to pressure test the injection flow loop, running an injection mandrel down to the injection adapter, wherein the injection mandrel includes a test plug, and landing the injection mandrel on the slidable sleeve, wherein the slidable sleeve is moved to the second position. The method of installing a re-injection system on a subsea wellhead may further comprise the step of using the test plug to pressure test the injection mandrel.

Another embodiment of a method of installing a re-injection system on a subsea wellhead is disclosed. The method comprising connecting a sliding sleeve to an exterior surface of an injection adapter ring, wherein the adapter ring has an interior bore and the sliding sleeve is movable from a first closed position to a second open position. The method includes connecting a slidable sleeve to the interior bore of the adapter ring, wherein the slidable sleeve may be moved from a first position where it protects a sealing surface on the interior bore of the injection adapter ring to a second position. The method may also include installing the injection adapter ring onto a drilling guide base that includes an injection flow loop, wherein the exterior sliding sleeve of the injection adapter ring moves to the open position. The method may also include running the drilling guide base down to a conductor housing, installing the drilling guide base on the conductor housing, using the slidable sleeve in the first position to pressure test the injection flow loop, running an injection mandrel down to the injection adapter, wherein the injection mandrel includes a test plug, and landing the injection mandrel on the interior slidable sleeve of the injection adapter ring, wherein the interior slidable sleeve is moved to the second position. The method may also include the step of removing the drilling guide base from the wellhead, wherein the exterior sliding sleeve moves to the closed position.

In one embodiment, a network of multiple subsea wells may be adapted to re-inject drill cuttings into a pressure containing conduit of one of the wells that has been adapted to inject and store drill cuttings. The one well may include an injection inlet, a flow path through the well formation, and an annulus within the well, wherein the flow path connects the annulus to the injection inlet. The one well may also include an isolation sleeve that prevents the injection of drill cuttings when the isolation sleeve is in a closed position. The flow path of the one well may be maximized to accommodate the flow of drill cuttings from multiple wells from the network. Additionally, the configuration of the flow path may create a cyclone effect within the flow path to minimize erosion due to the re-injection of the drill cuttings. A second well of the network may also be adapted to store drill cuttings from the system. The second well would be adapted to comprise the same drill cutting re-injection system as the first adapted well. Each of the wells of the network may be fluid connected to the injection inlets of both the first and second adapted wells to allow for the re-injection of drill cuttings from the entire network into either the first or the second well.

Figure 1:
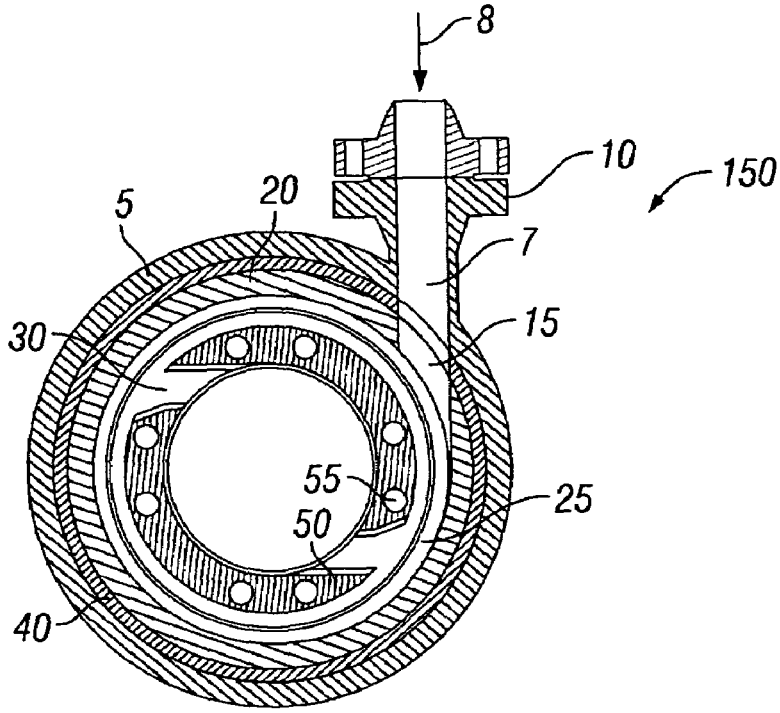
FIG. 1 is a top view cross-section of one embodiment of the re-injection system 150 of the present disclosure.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use a system to re-inject drilling cutting back into a subsea formation. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those ordinary skill in the art having the benefit of this disclosure.

Further aspects and advantages of the various embodiments of the invention will become apparent from consideration of the following description and drawings.

FIG. 1 shows the top view cross-section of a re-injection system 150 of the present disclosure. The re-injection system 150 includes an injection sleeve 5 of a drilling guide base 200. The drilling guide base 200 (shown in FIGS. 2 and 9) is adapted to be connected to conventional well heads and does not require the re-design of a new well head. The drilling guide base includes an injection sleeve 5 and an injection inlet 10. The injection inlet 10 includes a flow path 7 that allows for the flow of material from an injection source 8 through the injection inlet 10 and the injection sleeve 5. The injection inlet 10 is connected to an injection source 8, which may be in fluid communication with the surface to provide for the re-injection of filtered slurry, which includes drill cuttings. The drill cuttings may be filtered at a surface location by means known to those of ordinary skill in the art. Various means could connect the injection inlet 10 to a source of filtered slurry as would be appreciated by one of ordinary skill in the art having the benefit of this disclosure. The injection inlet 10 provides for the re-injection of the cutting into the remainder of the system through above referenced flow path 7.

The flow path 7 of the injection sleeve 5 is in communication with an opening 15 of an injection adapter ring 20 positioned within the injection sleeve 5. The opening 15 is in fluid communication with a circular gallery 25 of an injection adapter ring 20. The circular gallery 25 circumscribes the inner diameter of the injection adapter ring 20 and provides a flow path for the re-injected slurry. As would be appreciated by one of ordinary skill in the art, the dimensions of the circular gallery could be varied depending on the desired flow rate of the slurry through the re-injection system.

The re-injection system of FIG. 1 includes an isolation sleeve 40. The operation of the isolation sleeve 40, also referred to as a shut off sleeve, is described below in references to FIGS. 7A-7D. The isolation sleeve 40 is adapted to move between a first position and a second position when the drilling guide base 200 is removed. In the second position, isolation sleeve 40 blocks flow path 7 from communication with the opening 15 in the injection adapter ring 20 preventing the re-injection of slurry into the re-injection system 150. The isolation sleeve 40 may be moved into the second position to temporarily stop the re-injection of slurry or may be may be moved into the second position upon the completion of drilling the well bore by removal of the drilling guide base 200. The isolation sleeve may be slidably connected to the injection sleeve 5 and/or the injection adapter ring 20.

The injection adapter ring 20 is connected to the conductor housing and includes a circular gallery 25 that circumscribes the inner diameter of the injection adapter ring 20. The circular gallery 25 is positioned to align with the flow path 7 of the injection sleeve 5. The circular gallery 25 provides a flow path for the slurry around the inner portion of the injection adapter ring 20. The shape and dimensions of the circular gallery may be varied to allow different flow rates of re-injected slurry as would be appreciated by one of ordinary skill in the art. In one embodiment, the injection adapter ring 20 may be a 30" ring.

In the injection system 150 of FIG. 1, an injection mandrel 50 is located within the injection adapter ring 20. The injection mandrel 50 includes injection ports 30. As shown in FIG. 1, the injection mandrel may include two injection ports 30 that are in fluid communication with the circular gallery 25 of the injection adapter ring 20. The injection ports 30 may be balanced around the perimeter of the injection mandrel 50 to help minimize the amount or erosion caused by the flow of slurry within the system. Additionally, the injection ports 30 may be configured to reduce erosion caused by the flow of slurry past the injection mandrel 50. For example, the entrance into the injection ports may be rounded and/or the ports may be angled or aligned with the flow path to minimize erosion. The number and configuration of injection ports 30 may be varied to provide multiple injection points around the injection mandrel 50 as would be appreciated by one of ordinary skill in the art having the benefit of this disclosure. The injection mandrel 50 of FIG. 1 includes flow-by ports 55 that allow for the passage of material, such as cement or drilling mud, to pass through the re-injection system 150 without interrupting the re-injection of slurry.

Figure 3:
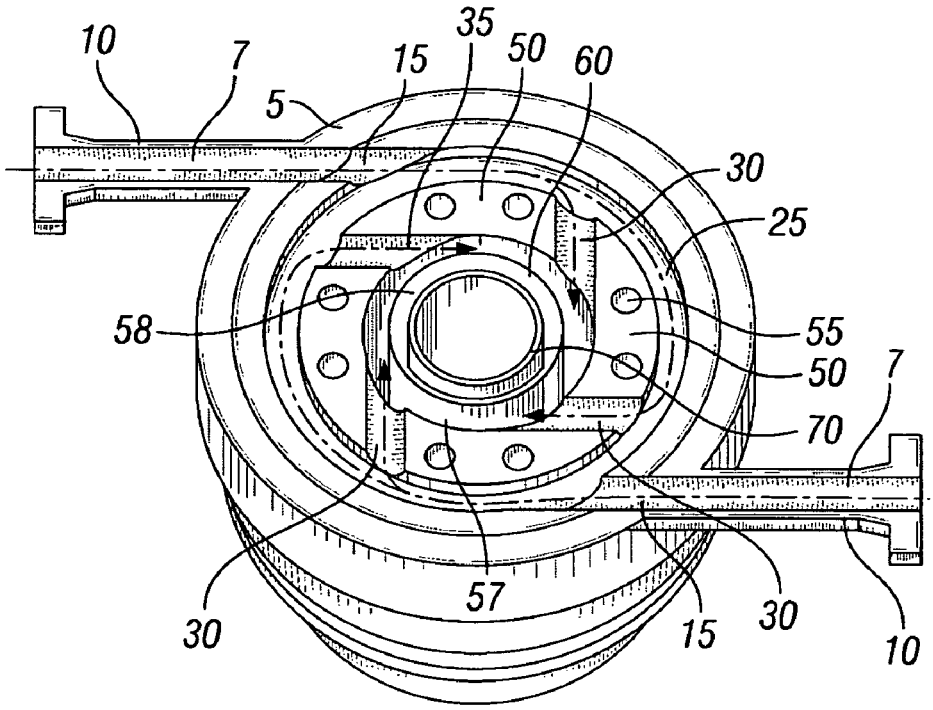
FIG. 3 is a top view cross-section of an embodiment of the re-injection system 150 having two opposing injection inlets 10.
Figure 4:
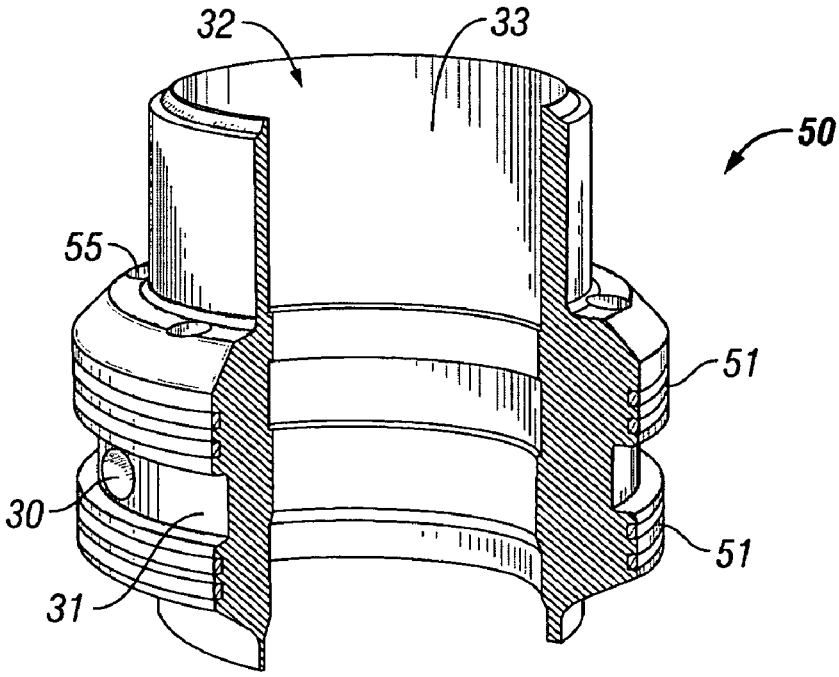
FIG. 4 is an isometric cut-away view of one embodiment of an injection mandrel 50 of the present disclosure.

The injection ports 30 of the injection mandrel 50 are in communication with an annulus 57 between the injection mandrel 50 and an inner casing 60 (Shown in FIGS. 3 and 4). The injection ports 30 are configured to direct the flow of slurry into the annulus 57. The annulus 57 is used to store the slurry containing the drill cuttings in the well formation preventing potential environmental contamination by the drill cuttings. The opening size of the injection ports 30 could be varied to affect the flow rate into the annulus 57 as would be recognized by one of ordinary skill in the art having the benefit of this disclosure.

Figure 2:
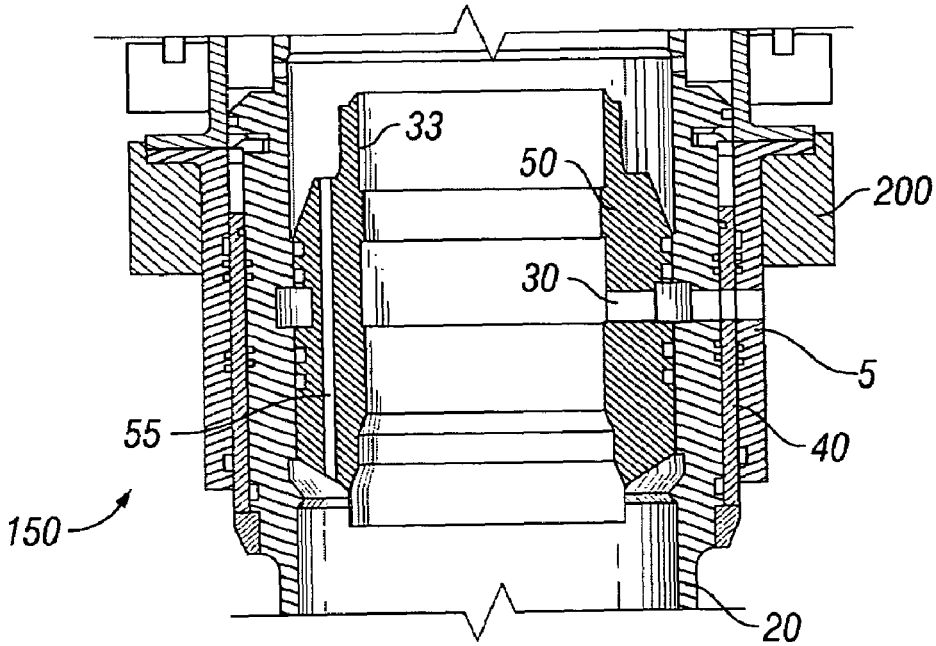
FIG. 2 is a side view cross-section of the one embodiment of the re-injection system 150 of the present disclosure.

FIG. 2 shows a side view cross-section of an injection system 150 of the present disclosure. A drilling guide base 200 may be connected to the conductor housing. The drilling guide base 200 includes an injection sleeve 5. An isolation sleeve 40 is positioned between the injection sleeve 5 and an adapter injection ring 20. The isolation sleeve 40 may be movable connected to the injection sleeve 5 and the adapter injection ring 20 such that isolation sleeve may be moved to prevent fluid communication between a flow path in the injection sleeve 5 and a flow path in the injection adapter ring 20.

FIG. 3 shows a top view cross-section of an embodiment of the re-injection system 150 wherein the injection mandrel 50 has four injection ports 30. In this embodiment there are two injection inlets 10 from which slurry may enter into the system. The injection inlets 10 may be positioned on opposite sides of the re-injection system, thus injection slurry into the system 150 in opposite directions. The location of the injections inlets 10 creates a cyclone effect within the circular gallery 25 of the injection adapter ring 20. The cyclone effect helps to minimize erosion as the slurry circles the gallery 25 and is directed into the annulus 57 by injection means. The injection means may be injection ports 30.

As shown in FIG. 3, the injection mandrel 50 may include four injection ports 30 angled to direct the flow of slurry into the annulus 57. The configuration of injection ports 30 may be balanced around the injection mandrel 50 to minimize erosion of the inner casing 60 due to the injection of slurry into the annulus 57. As shown, the flow 35 of the slurry is directed into the annulus 57 by the injection ports 30. A second inner casing 70 may be provided located within inner casing 60 creating a second annulus 58. As shown, two bypass ports 55 may be provided between each of the injection ports 30. The bypass ports 55 may allow the passage of material past the injection mandrel 50 without interruption to the injection of slurry into the annulus 57.

FIG. 4 shows a cut-away view of one embodiment of an injection mandrel 50. The injection mandrel 50 includes an injection port 30 which is in communication with a fluid flow path 31 around the injection mandrel 50. The injection port 30 is also in fluid communication with the inner cavity 32 of the injection mandrel 50. When installed in the re-injection system, the inner wall 33 of the injection mandrel 50 creates an annulus 57 with an inner casing 60. The fluid flow path 31 of the injection mandrel 50 is in fluid communication with the circular gallery 25 of the injection adapter ring providing a flow path that allows the re-injected slurry to travel around the injection mandrel 50. The injection port 30 may be adapted to direct flow of the slurry through the injection port and into the annulus 57. The injection mandrel 50 also includes bypass ports 55 located around the perimeter. The bypass ports 55 allow for the passage of material past the injection mandrel 50 without interfering with the re-injection of slurry through injection ports 30 into the annulus 57. Although only one injection port 30 is shown in FIG. 4, the number, location, and configuration of the injection ports 30 could be varied as would be appreciated by one of ordinary skill in the art having the benefit of this disclosure. The injection mandrel 50 also includes sealing means 51 to provide a sealing connection with the injection adapter ring 20 of the re-injection system 150.

Figure 5:
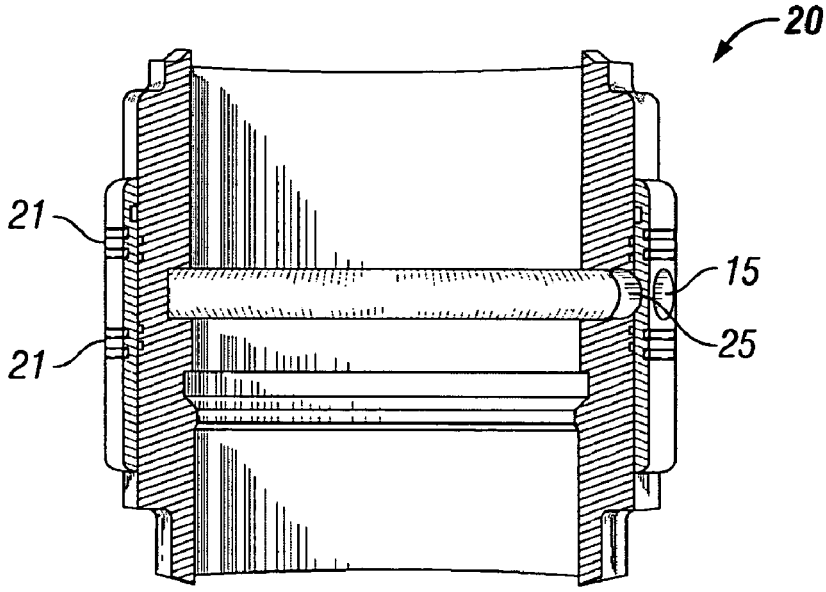
FIG. 5 is an isometric cut-away view of one embodiment of an injection adapter ring 20 of the present disclosure.

FIG. 5 shows one embodiment of the injection adapter ring 20 of the present disclosure. The injection adapter ring 20 includes opening 15, which is in fluid communication with circular gallery 25 that circumscribes the perimeter of the injection adapter ring 20. When assembled as part of the re-injection system 150, the circular gallery 25 is in fluid communication with the fluid flow path 31 and injection ports 30 of the injection mandrel 50. The opening 15 of the injection adapter ring 20 is also in fluid communication with the fluid flow path 7 of the injection sleeve 5 as discussed above. The injection adapter ring 20 includes sealing means 21 to provide a sealing connection with the injection sleeve 5 of the drilling guide base 200.

Figure 6:
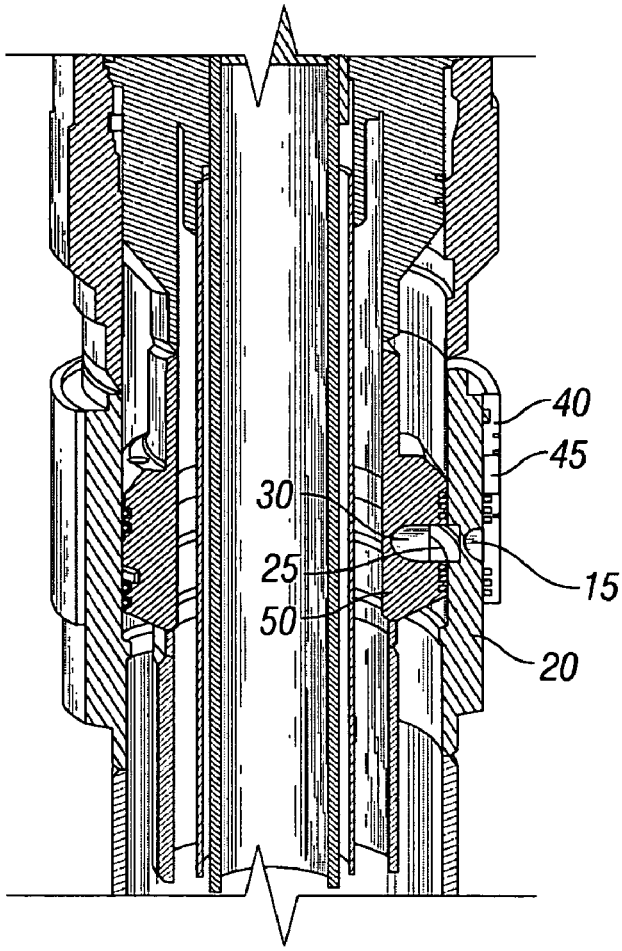
FIG. 6 is an isometric cut-away view of the re-injection system 150 with the isolation sleeve 40 in the closed position.

FIG. 6 is a cross-section showing the isolation sleeve 40 in a closed position preventing the injection of slurry into injection adapter ring 20. Isolation sleeve 40 includes an opening 45 and is slidable connected to the injection adapter ring 20. When in the closed position, the opening 45 of the isolation sleeve 40 is no longer in fluid communication with the opening 15 of the injection adapter ring 20. As shown in FIG. 6, the opening 15 of the injection adapter ring 20 is in fluid communication with a circular gallery 25 as well as an injection port 30 of an injection mandrel 50. The isolation sleeve 40 may be held in to closed position by a detent ring, as shown in FIG. 7D.

Figure 7D:
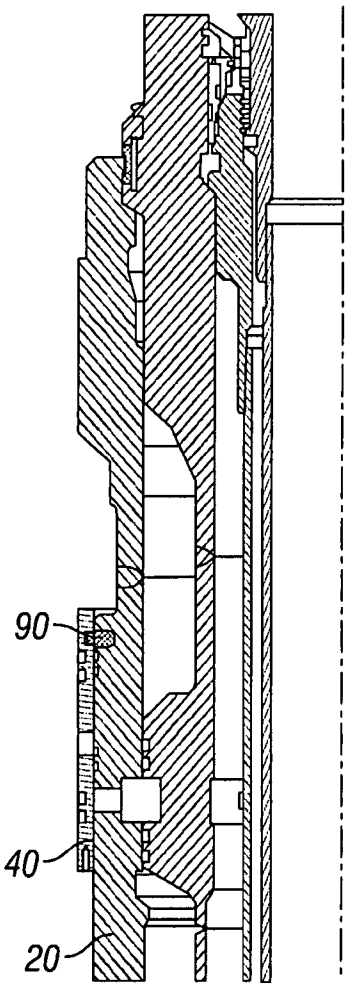
FIGS. 7A-7D show the movement of the isolation sleeve 40 when the injection sleeve 5 of the drilling guide base is removed from the wellhead.
Figure 7C:
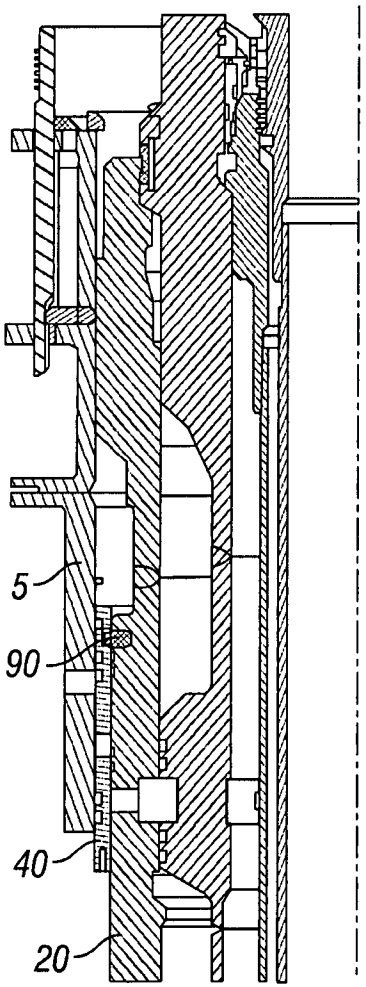
Figure 7B:
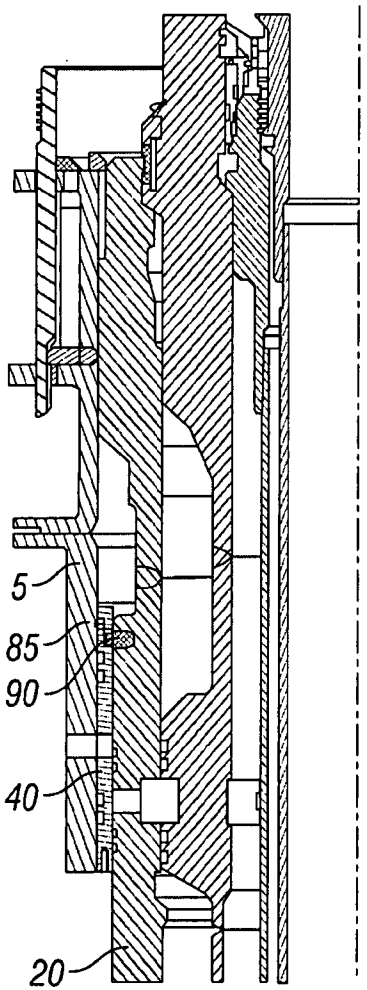
Figure 7A:
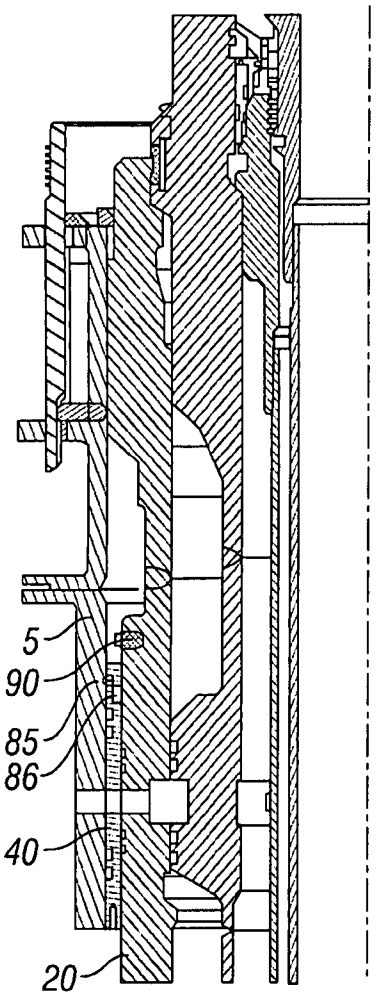

FIGS. 7A-7D show the retrieval of the drilling guide base once the drilling operations are concluded and there is no further need to re-inject drill cuttings into the wellhead. The drilling guide base running tool 300 (shown in FIG. 9) is run to retrieve the drilling guide base 200. The running tool 300 unlatches the drilling guide base 200 from the conductor housing. As shown in FIG. 7B, as the drilling guide base 200 moves upwards away from the wellhead the injection sleeve 5, pulls the isolation sleeve 40 upwards. Shear pins 85 connect the isolation sleeve 40 to the injection sleeve 5. The isolation sleeve 40 includes a recessed portion 86 adapted to receive a detent ring 90 positioned on the exterior of the injection adapter ring. Once the detent ring 90 engages with the recess 86, the ring will close the sleeve and the sleeve shoulders out on an edge on the injection adapter ring allowing the shear pins to shear, thus releasing the drilling guide base 200 from the conductor housing. As shown in FIG. 7C, the shear pin 85 breaks allowing the injection sleeve 5 to move upwards with respect to the isolation sleeve 40, which remains connected to the injection adapter ring 20. The isolation sleeve 40 seals the inlet in the injection adapter ring 20, as discussed above. After the shear pin 85 has sheared the drilling guide base 200 may be removed from the wellhead as shown in FIG. 7D.

Figure 8:
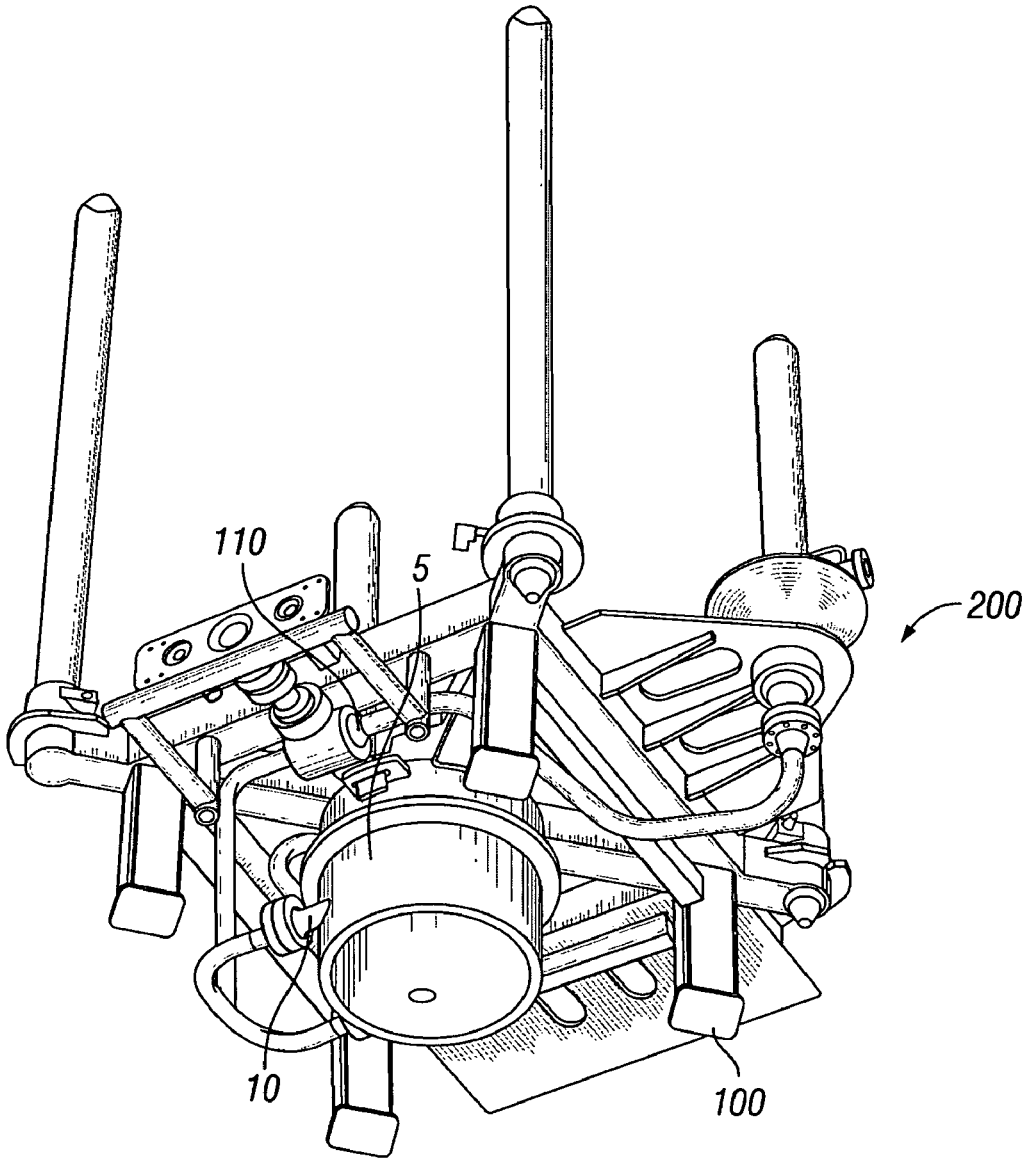
FIG. 8 is an isometric view one embodiment of the drilling guide base 200 of the present disclosure.

FIG. 8 is an isometric bottom view of the drilling guide base 200. The drilling guide base 200 includes an injection sleeve 5 that connects to the injection adapter ring when installed onto the wellhead. The drilling guide base 200 shown also includes two injection inlets 10 one the same side of the injection sleeve 5 that are in communication with a flow path through the injection sleeve 5. The location and number of injection inlets may be varied within the invention as would be appreciated by one of ordinary skill in the art having the benefit of this disclosure. The drilling guide base 200 also includes a slurry injection valve system to control the injection of slurry into the re-injection system. The valve may allow for the remote control of the re-injection system. The drilling guide base 200 also includes support legs 100 for support of the guide on the wellhead. The drilling guide base may be installed onto a wellhead in a number of different ways.

In a satellite application, the drilling guide base 200 may be previously installed onto an injector adapter ring 20 that then may be run to the wellhead. Alternatively, the drilling guide base may be run remotely and attached to the injector adapter ring 20. In both instances, the drilling guide base 200 may be retrieved from the wellhead prior to completion of the well.

The pressure integrity of the injection adaptor ring 20 may be maintained by an external shut-off sleeve (see FIGS. 7A-7D) which seals the injection adapter ring inlet 15 when the drilling guide base 200 is no longer attached to the conductor housing. When the drilling guide base 200 is attached it pushes the external shut-off sleeve 40 to the open position providing communication between the injection inlet 10 and the circular gallery 25 of the injection adaptor ring 20. The interface between the drilling guide base 200 and the injection adaptor ring 20 is such that the sleeve 40 is automatically opened when the drilling guide base 200 is installed and closed when the drilling guide base 200 is removed. This may be in conjunction with control valves positioned in the flow loop to control any pressure which may appear in the re-injection system 150.

Figure 9:
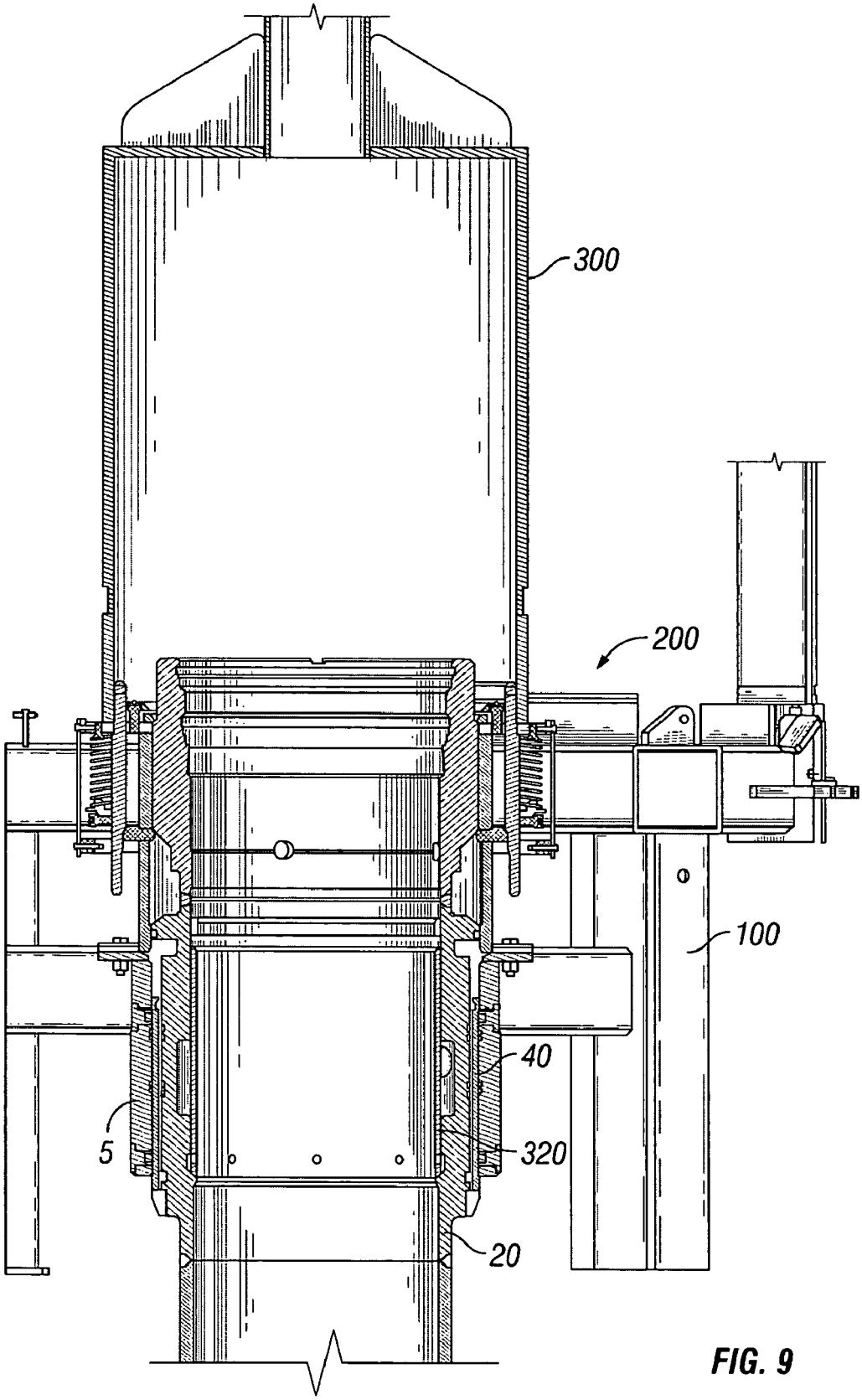
FIG. 9 shows an embodiment of the present disclosure that includes a sliding sleeve bore protector 320 in a satellite installation of the drilling guide base 200.

To prevent damage to the internal sealing surfaces on the injection adaptor ring 20, a sliding sleeve bore protector (SSBP) 320 may be included in the system as shown in FIG. 9. The SSBP 320 is designed such that it is positioned to protect the seal surfaces during running the adaptor through to completion of drilling and remains in this position until the injection mandrel 50 is run. The injection mandrel lands on the top face of the SSBP 320 and slides it down thus exposing the sealing surfaces on the injection adaptor ring. When the injection mandrel is fully landed, the circular gallery 25 is formed with the seals on the injection mandrel 50 providing pressure containment. In the event that the injection mandrel 50 needs to be retrieved, the SSBP 320 will be automatically returned to it original position thus protecting the seal surface on the injection adaptor ring 20. The SSBP 320 provides the ability to pressure test the injection flow loop and valves on the drilling guide base 200 if the injection adaptor ring 20 is pre-installed in the drilling guide base 200. Further, SSBP 320 allows for pressure testing the seal between the injection adaptor ring 20 and the drilling guide base 200.

Figure 10:
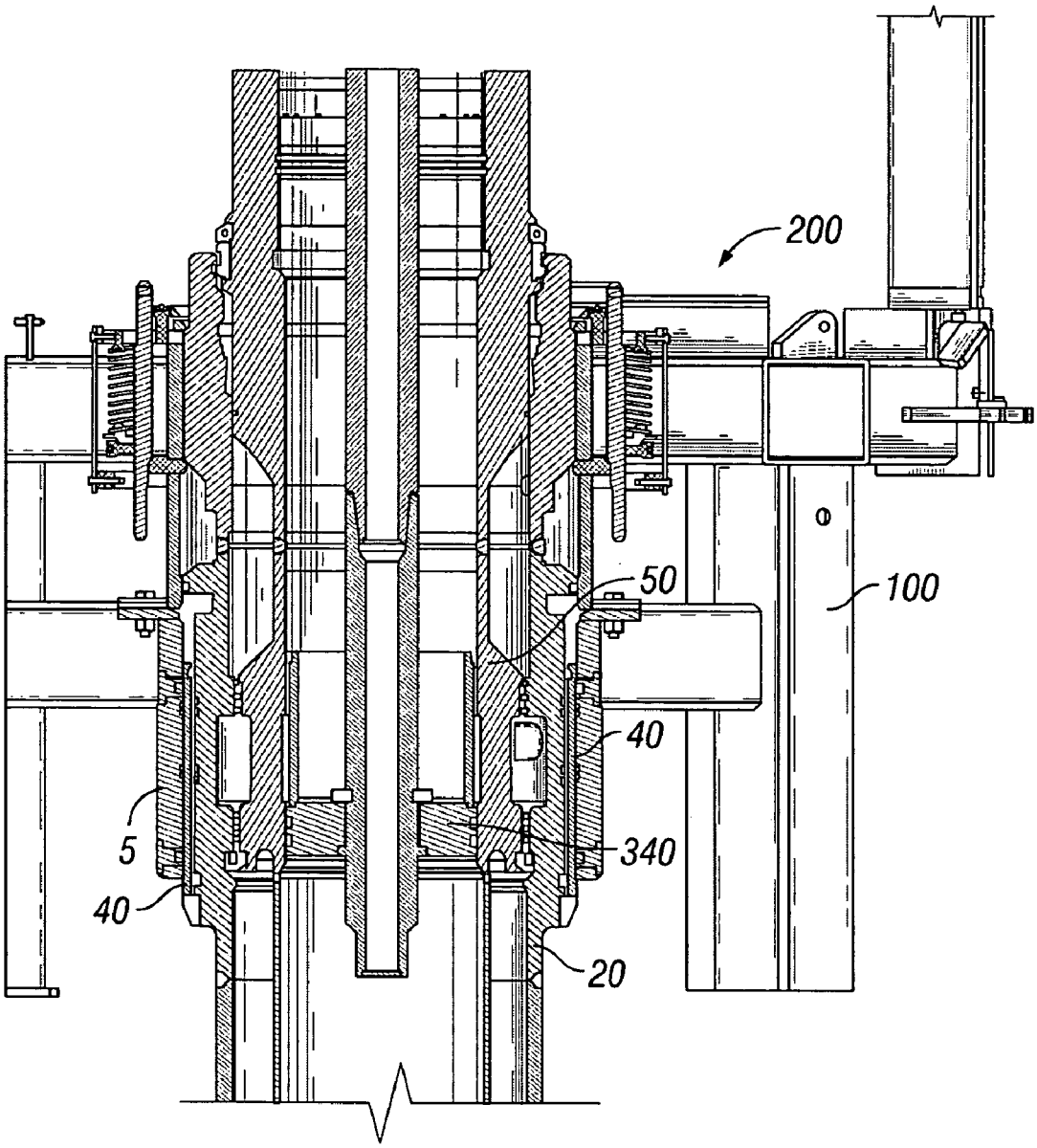
FIG. 10 shows the embodiment of FIG. 10 with the injection mandrel 50 landed within the re-injection system on the sliding sleeve bore protector.

The injection mandrel 50 may be run with a test plug 340 that seals on its bore as shown in FIG. 10. The test plug 340 allows for the pressure testing of the injection mandrel 50 prior to re-injection. When the injection mandrel 50 has been landed within the system a pressure test can be performed on the inner diameter of the injection mandrel 50 to test the integrity of the seals between the outer diameter injection mandrel 50 and the inner diameter of the injection adaptor ring 20.

Figure 11:
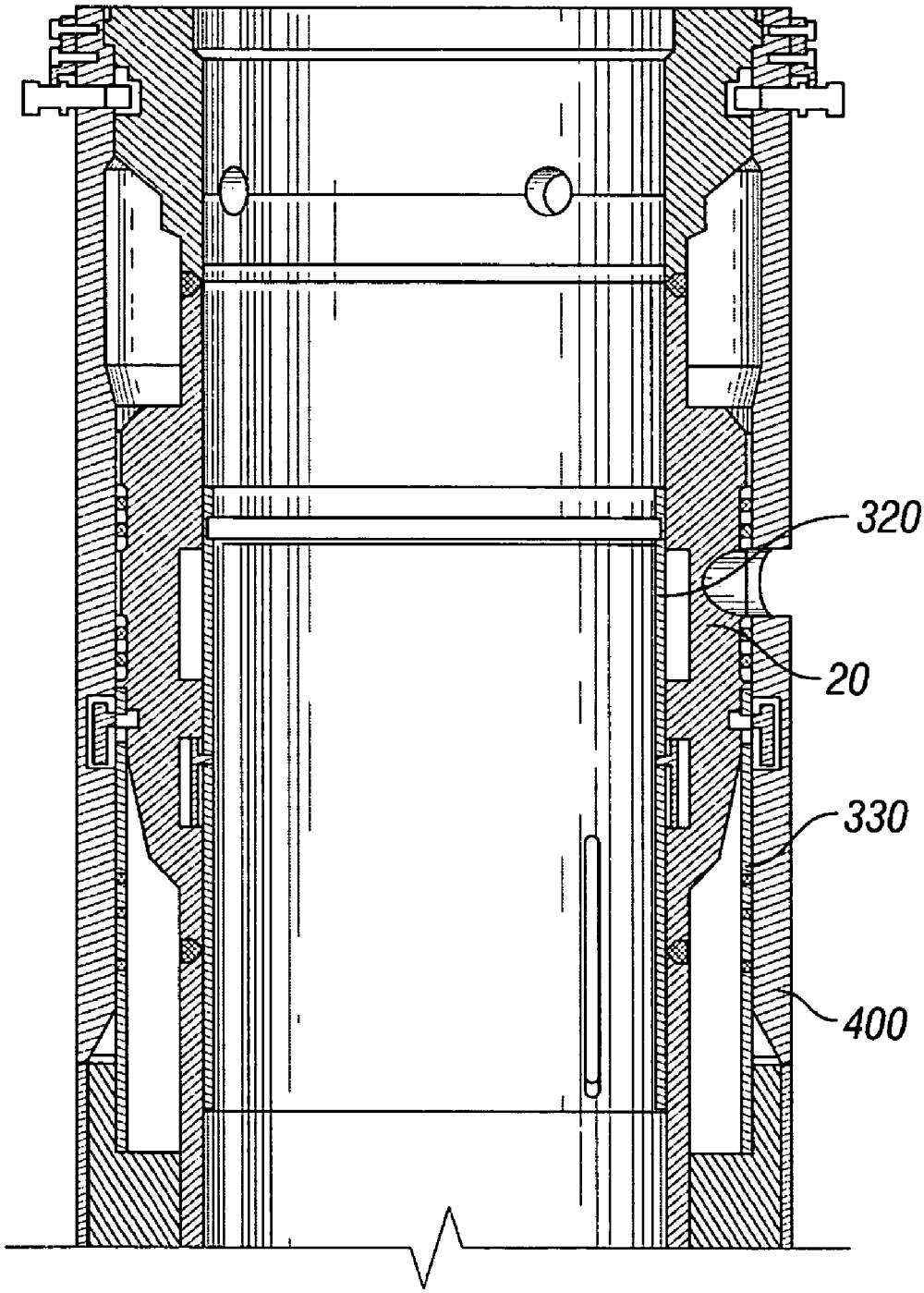
FIG. 11 shows an embodiment of the present disclosure that includes a template receptacle sliding sleeve bore protector 330 as well as a sliding sleeve bore protector 320 in a template installation of the drilling guide base 200.

In another embodiment, a different SSBP 330 may be an integral part of a template receptacle as shown in FIG. 11. This allows for the pressure testing of the valves and injection flow loop by pressurising against the SSBP 330. The SSBP 330 is locked in position during drilling operations and protects the sealing areas that will be used by the injection adaptor ring 20.

In order to land the injection adaptor ring 20 into its final position within the re-injection system 150, the SSBP 330 has to be first unlocked from its original position in the template receptacle. Typically, the SSBP 330 will be unlocked by a remote operated vehicle causing it to automatically move to the open position as shown in FIG. 12. If the injection adapter ring 20 needs to be retrieved from the re-injection system 150, the SSBP 330 will automatically slide back to its original position thus protecting the seal surfaces. As with the above embodiment, a SSBP 320 may be prevent damage to the internal sealing surfaces of the injection adapter ring 20 providing the ability to pressure test the injection flow loop and valves on the template and the seals between the injection adaptor ring 20 and template receptacle 400. The injection mandrel 50 of this embodiment is identical to above embodiment and as such may be run with a test plug 340 that seals on its bore. The test plug 340 allows for the pressure testing of the injection mandrel 50 prior to re-injection. When the injection mandrel 50 has been landed within the system a pressure test can be performed on the inner diameter of the injection mandrel 50 to test the integrity of the seals between the outer diameter injection mandrel 50 and the inner diameter of the injection adaptor ring 20.

Although various embodiments have been shown and described, the invention is not so limited and will be understood to include all such modifications and variations as would be apparent to one skilled in the art.

What is claimed is:

1. A system to re-inject cuttings into a wellhead comprising:

at least one injection inlet;

a drilling guide base, the drilling guide base including at least one flow path in communication with the at least one injection inlet;

an injection adapter ring within the drilling guide base;

a circular gallery vertically contained by the injection adapter ring, the circular gallery in communication with the at least one flow path of the drilling guide base;

an injection mandrel within the injection adapter ring, the injection mandrel including at least one injection port in communication with the circular gallery of the injection adapter ring; and an inner casing within the injection mandrel forming an annulus between the injection mandrel and the inner casing, wherein cuttings may be injected into the annulus through the at least one injection port.

2. The system of claim 1, wherein the at least one injection port is positioned in relation to the circular gallery to create a cyclone effect within the system.

3. The system of claim 1, wherein the at least one injection port is adapted to reduce erosion on the injection mandrel.

4. The system of claim 1 further comprising multiple injection inlets and wherein the injection mandrel includes multiple injection ports.

5. The system of claim 4, wherein the multiple injection ports and the multiple injection inlets are balanced to reduce erosion on the inner casing.

6. The system of claim 1, wherein the injection mandrel further includes at least one flow-by port adapter to permit the passage of material through the injection mandrel.

7. The system of claim 6, wherein the material is cement, drilling mud, drilling fluid, or a gas.

8. The system of claim 1 further comprising a sleeve positioned between the drilling guide base and the injection adapter ring, the sleeve being adapted to move from a first position to a second position.

9. The system of claim 8, wherein the sleeve in the second position prevents communication between the flow path of the drilling guide base and the circular gallery of the injection adapter ring.

10. The system of claim 1 further comprising a second inner casing within the inner casing.

11. The system of claim 10, wherein the wellbore may be drilled in the second inner casing while cuttings are re-injected into the annulus between the inner casing and the injection mandrel.

12. The system of claim 1, wherein the at least one injection inlet has an inner diameter of at least four inches.

13. The system of claim 12, wherein the inner casing is a 13⅜" casing and the injection mandrel is an 18¾" injection mandrel.

14. The system of claim 1, wherein the drilling guide base is adapted to connect to a conventional subsea wellhead.

15. The system of claim 1, wherein the injection mandrel is landed on a sliding sleeve.

16. The system of claim 15, wherein if the injection mandrel is removed the sliding sleeve protects a seal surface of the injection adapter ring.

17. A method of injecting slurry into a wellbore annulus comprising the steps of;

filtering the slurry, the slurry comprising drilling mud and drill cuttings;

pumping the filtered slurry through at least one injection inlet into a pressure containing conduit, the at least one injection inlet being in fluid communication with a flow path within a drilling guide base;

pumping the filtered slurry through the flow path of the drilling guide base to a flow path of an injection adapter ring, wherein the flow path of the injection adapter ring is a circular gallery vertically contained by the injection adapter ring;

circulating the filtered slurry around the circular gallery of the injection adapter ring, the circular gallery being in fluid communication with the at least one injection port of an injection mandrel;

directing the filtered slurry through the at least one injection port of the injection mandrel to an annulus, the annulus formed between the injection mandrel and an inner casing within the pressure containing conduit.

18. The method of claim 17 further comprising the step of moving an isolation sleeve to block the fluid communication between the drilling guide base and the injection adapter ring.

19. The method of claim 17, wherein the injection inlet is positioned relative to the circular gallery of the injection adapter ring such that a cyclone effect is created with the fluid flow path.

20. The method of claim 17 further comprising the step of drilling the wellbore while filtered slurry is re-injected into the annulus formed between the injection mandrel and an inner casing.

21. The method of claim 17, wherein the at least one injection port of the injection mandrel is adapted to minimize erosion to the injection mandrel.

22. The method of claim 17, wherein the injection mandrel includes at least one bypass port.

23. The method of claim 22 further comprising the step of pumping material through the at least one bypass port.

24. A system to store drilling slurry from multiple subsea wells comprising;

a well adapted to store drilling slurry comprising:

at least one injection inlet, wherein drilling slurry may enter the well through the one injection inlet;

a drilling guide base, the drilling guide base including at least one flow path in communication with the at least one injection inlet for the flow of drilling slurry;

an injection adapter ring;

a circular gallery vertically contained by the injection adapter ring, the circular gallery in communication with the at least one flow path of the drilling guide base wherein drilling slurry may flow around the circular gallery;

an injection mandrel, the injection mandrel including at least one injection port in communication with the circular gallery of the injection adapter ring;

an inner casing forming an annulus between the injection mandrel and the inner casing, wherein the at least one injection port of the injection mandrel injects drilling slurry into the annulus; and an isolation sleeve, the isolation sleeve being adapted to block the communication between the circular gallery and the at least one flow path of the drilling guide base;

at least a second well adjacent to the well adapted to store drilling slurry, wherein drilling slurry from the at least second well is brought to the surface and filtered; and a first fluid conduit for the transportation of the filtered drilling slurry to the at least one injection inlet of the well adapted to store drilling slurry.

25. The system of claim 24 further comprising a second fluid conduit for the transportation of filtered drilling slurry from a third well to the at least one injection inlet for the re-injection of the filtered slurry.

26. The system of claim 24, wherein the drilling guide base is part of a subsea manifold or a subsea template.

27. A method of installing a re-injection system on a subsea wellhead comprising;

connecting an isolation sleeve to an exterior surface of an injection adapter ring, wherein the injection adapter ring has an interior bore and the isolation sleeve is movable from a closed position to an open position;

connecting a slidable sleeve to the interior bore of the isolation sleeve, wherein the slidable sleeve may be moved from a first position where it protects a sealing surface on the interior bore of the injection adapter ring to a second position;

installing the injection adapter ring onto a drilling guide base that includes an injection flow loop, wherein the drilling guide base moves the isolation sleeve to the open position;

running the drilling guide base down to a conductor housing of a wellhead;

installing the drilling guide base on the conductor housing;

using the slidable sleeve in the first position to pressure test the injection flow loop;

running an injection mandrel down to the conductor housing, wherein the injection mandrel includes a test plug; and landing the injection mandrel on the slidable sleeve, wherein the slidable sleeve is moved to the second position.

28. The method of claim 27 further comprising the step of using the test plug to pressure test the injection mandrel.

29. The method of claim 28 further comprising the step of removing the drilling guide base from the wellhead, wherein the isolation sleeve moves to the closed position.

30. A system to inject material into a well formation for disposal and storage comprising;

at least one injection inlet;

a drilling guide base, the drilling guide base including at least one flow path in communication with the at least one injection inlet;

an injection adapter ring within the drilling guide base;

a circular gallery vertically contained by the injection adapter ring, the circular gallery in communication with the at least one flow path of the drilling guide base;

an injection mandrel within the injection adapter ring, the injection mandrel including at least one injection port in communication with the circular gallery of the injection adapter ring; and an inner casing within the injection mandrel forming an annulus between the injection mandrel and the inner casing the annulus being in communication with the at least one injection port, wherein material may be injected into the well formation through the annulus.

* * * * *